United States Patent [19]

Beran et al.

[11] Patent Number: 4,968,387

[45] Date of Patent: Nov. 6, 1990

[54] PAPERMACHINE DECKLE MEANS

[75] Inventors: Robert L. Beran, Covington; Ralph S. Peterson, Clifton Forge; William J. Thurston, Covington, all of Va.

[73] Assignee: Westvaco Corporation, New York, N.Y.

[21] Appl. No.: 468,764

[22] Filed: Jan. 23, 1990

[51] Int. Cl.[5] ..... D21F 1/56

[52] U.S. Cl. ..... 162/353; 162/354

[58] Field of Search ..... 162/353, 354, 331

[56] References Cited

U.S. PATENT DOCUMENTS

| | | | |
|---|---|---|---|
| 3,075,579 | 1/1963 | Winterburn . | |
| 3,361,620 | 1/1968 | Gedemer . | |
| 3,563,854 | 2/1971 | Nisser et al. | 162/353 |
| 3,607,624 | 9/1971 | Moody et al. | 162/353 |
| 3,928,124 | 12/1975 | Hansen . | |
| 4,738,751 | 4/1988 | Newcombe | 162/353 |

FOREIGN PATENT DOCUMENTS

| | | | |
|---|---|---|---|
| 2128252 | 10/1972 | France | 162/353 |

*Primary Examiner*—Karen M. Hastings

*Attorney, Agent, or Firm*—W. A. Marcontell; R. L. Schmalz

[57] ABSTRACT

The lateral edges of a papermachine forming fabric pond are contained by a deckle board having a bottom edge positioned above the forming fabric upper surface elements but below the fabric supported stock pond surface. Lateral edges of the forming fabric run under the deckle board and upon an edge support beam within an elongated fluid channel between the outside surfaces of the deckle board structure and the inside surfaces of the edge support beam. Fluid flow within the elongated fluid channel, preferably independent of the papermachine headbox slice opening, supplies the elongated fluid channel volume for a fluid barrier to pond stock loss under the deckle board bottom edge.

1 Claim, 2 Drawing Sheets

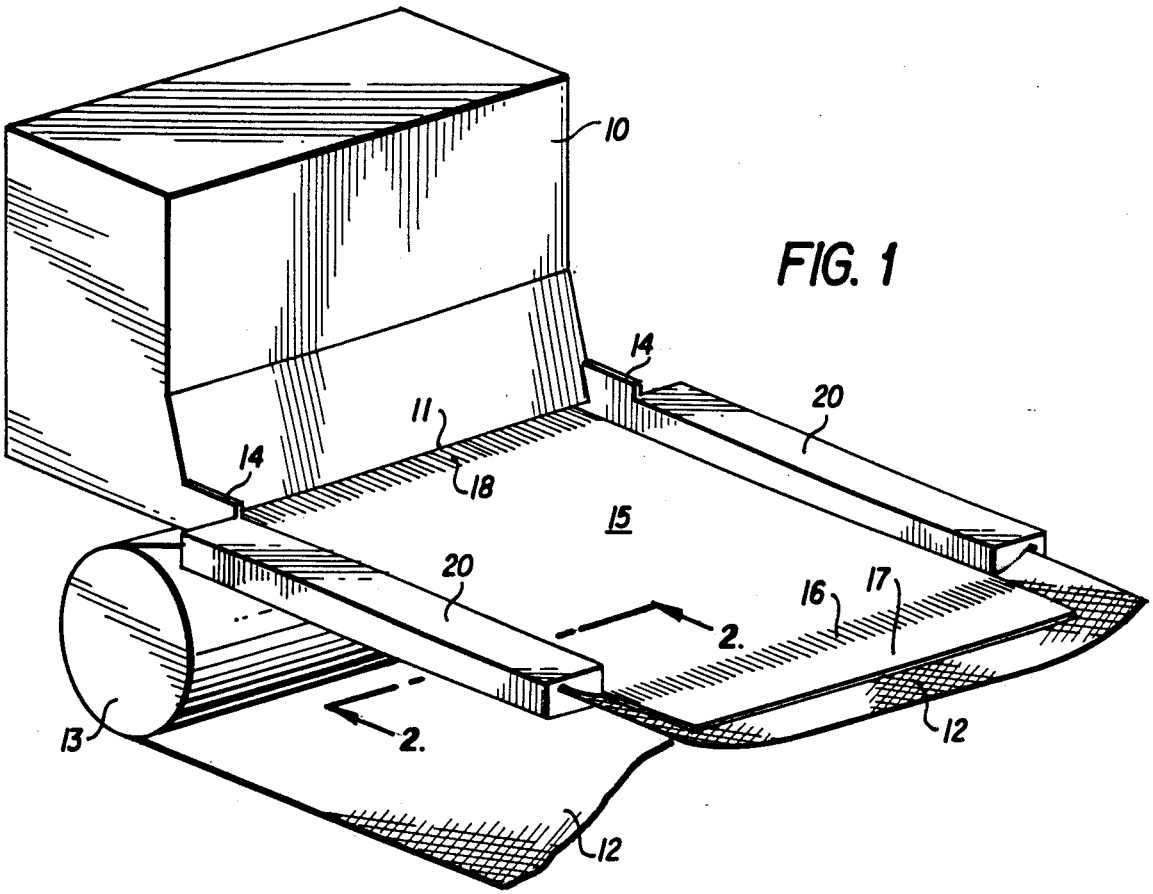
FIG. 1
FIG. 2
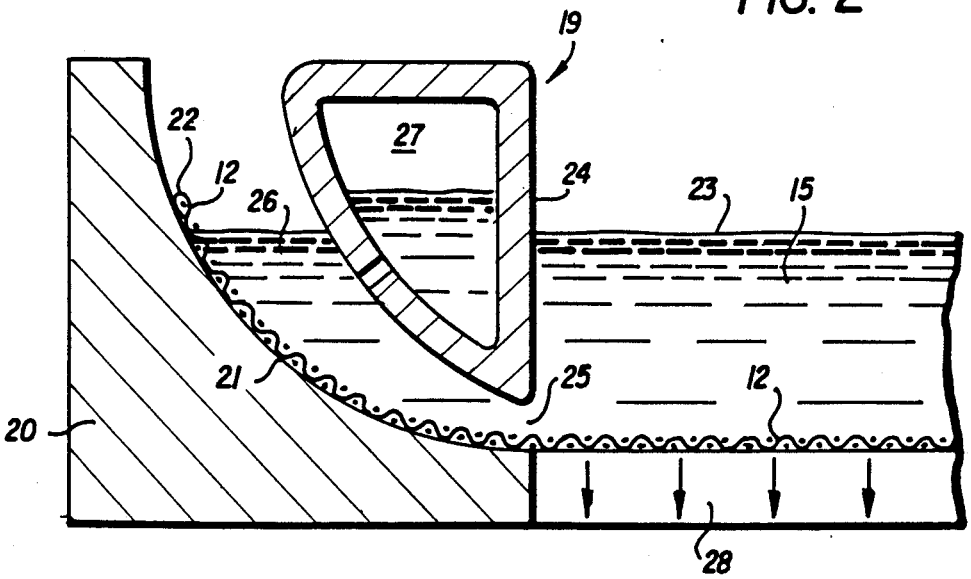

PAPERMACHINE DECKLE MEANS

BACKGROUND OF THE INVENTION

1. Field of the Invention:

The present invention relates to the art of continuous papermaking by means of aqueously suspended fiber discharged from a headbox slice opening upon a traveling forming screen or fabric.

2. Description of the Prior Art:

Papermaking stock is an extremely dilute, aqueous slurry of fiber; usually cellulose fiber or blended mixtures of natural and man-made fiber. Fourdrinier papermaking includes the process step of jetting a flow of papermaking stock from the slice opening of a headbox onto the surface of horizontally traveling screen or fabric belt.

As the traveling screen carries the stock flow from the slice jet landing zone, aqueous vehicle, i.e. water, drains through the fabric matrix to leave the fiber suspended on the fabric surface in a consolidated mat.

Between the stock landing zone and the longitudinally displaced point along the screen belt traveling route whereat the mat consolidates, the stock is supported on the screen surface as a liquid pond of diminishing depth. Without lateral containment, lateral pond flow cross-directionally distributes stock towards the screen sides thereby undesirably thickness tapering the resultant paper web edge areas.

To prevent undesirable tapered thickness along the web edges, lateral pond confinement structures called "deckle boards" are positioned above and along the screen edges out from the slice landing zone. Traditionally, deckle boards are bottom sealed to the upper screen surface with fabric or elastomer which, consequently, is a source of friction, drag and wear upon the screen surface.

Additionally, traditional deckle board structure is a source of standing waves in and across the stock pond. When consolidated by aqueous vehicle drainage, these deckle waves cause undesirable fiber concentration, i.e. basis weight, variations in the paper web product.

An object of this invention, therefore, is provision of a deckle structure having no frictional contact with the forming screen and does not propagate or reflect pond waves.

SUMMARY

These and other objects of the invention to be set forth more fully hereafter, are achieved by a lateral fluid channel along the deckle lines defined between a shallow depth deckle board that penetrates the fourdrinier table pond less than full depth and an outer channel boundary laterally beyond the deckle board edge. A fluid level maintained in the lateral fluid channel provides a hydrostatic balance for an effective seal with the main stock flow across the fluid communication space between the screen and the underside of the deckle board from a net fiber loss from the pond.

BRIEF DESCRIPTION OF THE DRAWING

Relative to the drawings wherein like reference characters designate like or similar elements throughout the several figures of the drawings:

FIG. 1 illustrates the wet end of a fourdrinier papermachine equipped with the deckle structure of the present invention;

FIG. 2 is a detailed sectional illustration of one embodiment of the present invention;

DESCRIPTION OF THE PREFERRED EMBODIMENT

Figure 3:
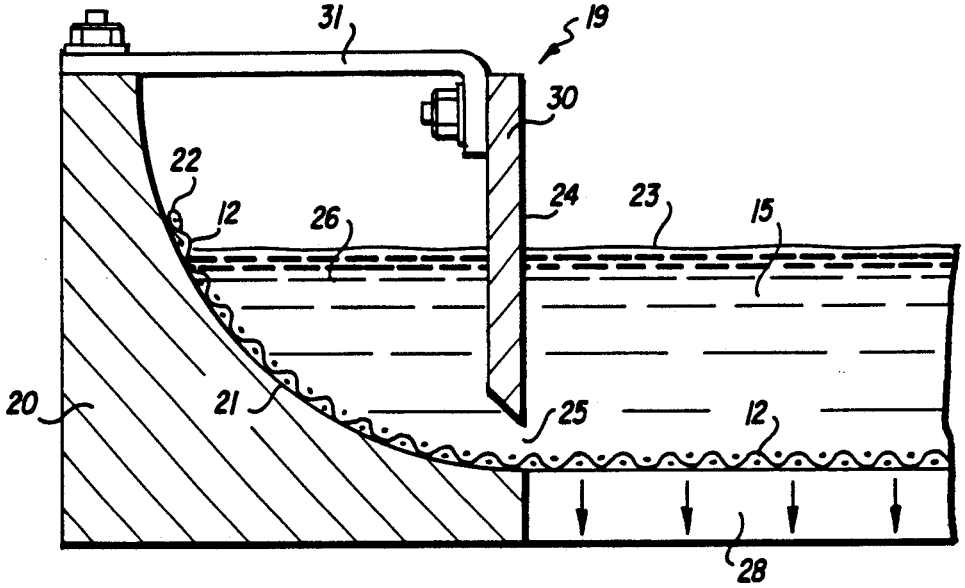
FIG. 3 is a detailed sectional illustration of a second embodiment of the present invention.

For environmental setting, the primary elements of a fourdrinier papermachine are illustrated by FIG. 1 and include a headbox 10 which discharges dilute, aqueous papermaking stock from a slice opening 11 onto a horizontally carried segment of an endless belt screen 12. The screen is turned about and drawn from a breast roll 13 under headbox 10. Extensions 14 from the slice end walls, characterized as "pond sides" or "cheeking pieces," confine the fluid stock beyond the plane of discharge from the slice and may include the line of stock landing 18 upon the screen 12.

Viewed dynamically, the jet of fluid stock lands upon the screen 12 which is moving at approximately the same horizontal velocity as the stock jet. Although drainage of the stock aqueous vehicle begins immediately, the initial drainage process continues for several seconds during which the stock remains as a highly fluidized pond 15. As this pond is carried away from the slice opening 11, water removal diminishes the pond depth until sufficient free water is removed to form a consolidated fibrous mat 17. That point of mat consolidation is observed on the machine as a "dry line" zone 16. Thus formed, the mat is further dried by pressure and heat to an integral, continuous paper web.

In transit, the pond 15 is laterally confined by deckle structure 19. Such deckle structure of the present invention is shown by the FIGS. 2 and 3 embodiments as including a deckle block 20 having a curved screen edge support surface 21 which carries the outer screen edge 22 above the pond surface level 23.

Vertical surface 24 of a deckle board is essentially a continuation of the inside cheeking piece 14 surface extended substantially parallel with the wire 12 running direction and defines the deckle plane. Structurally, this surface 24 projects below the pond surface 23 less than the full pond depth: 50% to 95%, for example. Below the deckle plane structure is an elongated fluid communication space 25 having a height, between the upper surface of the screen 12 and the lower deckle structure elements, of approximately 5% to 50% of the pond depth depending on the pond stock consistency.

The deckle board 27 of FIG. 2 is a hollow conduit which may be used to supply a substantially independent fluid channel 26 having a hydrostatic connection with the pond 15 along communication space 25. This channel 26 may be hydraulically sustained from either an independent water supply such as papermachine filtrate, papermaking stock supplied independently of the slice opening 11 or papermaking stock supplied through the headbox slice and the communication space 25.

Pond stock drainage occurs through the screen 12 over the foil supported area 28. No provision for drainage is made for the deckle block 20 although conduits may be used at the down machine end of the structure to duct away a seal fluid flow at the end of channel 26.

The invention embodiment of FIG. 3 is similar to that of FIG. 2 in most respects but differs by the provision of a simple deckle board element 30 supported by adjustable brackets 3!. In this embodiment the deckle seal channel 26 fluid level is maintained by external piping not shown.

Figure 4:
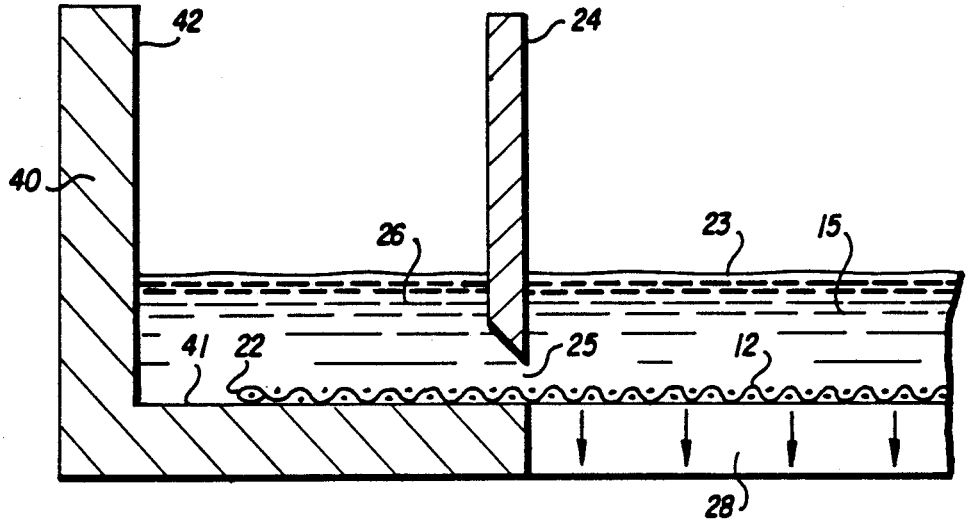
FIG. 4 is a detailed sectional illustration of a third embodiment of the present invention; and, FIG. 5 is a detailed sectional illustration of a fourth embodiment of the present invention.

The deckle structure of FIG. 4 includes a deckle block 40 having a flat bottom 41 of such width as to provide adequate running clearance between the screen end 22 and the straight, vertical outside 42. Pond drainage through the screen 12 is limited to the area 28. No drainage is drawn outside of the deckle plane 24.

Figure 5:
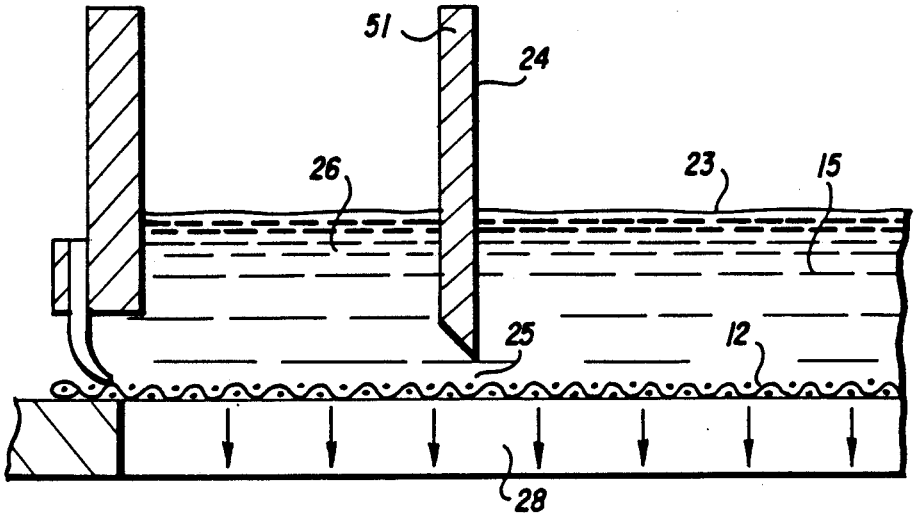

The invention according to FIG. 5 forms a seal channel 26 between a screen edge contacting friction seal 50 and a straight deckle board 51. Table drainage zone 28 is extended under the fluid communication space 25 and the seal channel 26. Use of papermaking stock for the sealing fluid in channel 26 of this embodiment will produce an independently consolidated fiber mat at the down machine end of the fourdrinier table. Normal edge trim devices may be used to trim these widened lateral strips of fiber from the central production web 17 at the couch roll or press section. Such trim is reslurried for return to the stock makeup system.

Common to all of the aforedescribed invention embodiments is a hydrostatic seal within the deckle plane above the screen. This fluid seal permits the transfer of wave energy generated on the pond 15 side of the deckle planes 24 into the seal channel 26 where it is harmlessly dissipated by reflection between the backside of the deckle board and the inside surface of the deckle block.

Additionally, the hydrostatic seal prevents the net loss or gain of stock across the deckle plane thereby maintaining a uniform fiber basis weight in the deckle plane area. Moreover, fluid addition to or extraction from the independent fluid channel 26 may be achieved without deleterious wave transmission into or across the pond 15.

Also common is the deckle surface 24 as an extension of the cheeking piece 14 for reduction or elimination of standing wave generation. Such waves arise from the sudden lateral fluid spread due to an abrupt loss of physical or hydraulic restraint. These deckle surfaces are extended along the machine direction by a distance sufficient to permit establishment of hydraulic equilibrium at the interface.

Having fully described our invention and the several preferred embodiments thereof, additional equivalent embodiments will readily occur to those of ordinary skill in the art. As our invention, however,

We claim:

1. A papermachine having headbox means with a slice opening for jetting a flow of aqueous papermaking stock onto a moving drainage screen, said screen supporting said stock flow in a horizontal plane as a shallow pond of diminishing depth corresponding to the distance removed from said slice opening, pond depth being determined between the surface of said pond and upper elements of said screen, said pond being laterally confined on said screen by deckle plane means located subsequent to said slice opening and having a bottom edge position above the drainage screen upper surface elements and extending below said pond surface by approximately 50 to 95 percent of said pond depth and fluid seal channel means laterally adjacent said deckle plane means to confine a deckle sealing fluid in flow communication with said pond in a sealing zone beneath said deckle plane means and wherein lateral edges of said screen are extended under and through said sealing zone, and said fluid seal channel means comprises a curved surface for cupping the lateral edges of said screen above said pond surface.

* * * * *